United States Patent [19]

Malmsten

[11] Patent Number: 4,840,703

[45] Date of Patent: Jun. 20, 1989

[54] METHOD FOR CONTROLLING AN OXYGEN BLEACHING

[75] Inventor: Erkki Malmsten, Rauma, Finland

[73] Assignee: Rauma-Repola Oy, Pori, Finland

[21] Appl. No.: 213,516

[22] Filed: Jun. 28, 1988

Related U.S. Application Data

[63] Continuation of Ser. No. 948,459, Dec. 31, 1986, abandoned, which is a continuation of Ser. No. 744,985, Jun. 17, 1985, abandoned.

[30] Foreign Application Priority Data

Nov. 8, 1984 [FI] Finland ..... 844390

[51] Int. Cl.[4] ..... D21C 7/12; D21C 9/147

[52] U.S. Cl. ..... 162/49; 162/62; 162/65; 162/238

[58] Field of Search ..... 162/49, 61, 238, 65, 162/263, 62; 422/112

[56] References Cited

U.S. PATENT DOCUMENTS

| | | | |
|---|---|---|---|
| 3,579,417 | 5/1971 | Carlsmith | 162/238 |
| 3,832,276 | 8/1974 | Roymoulik et al. | 162/61 |
| 4,198,266 | 4/1980 | Kirk et al. | 162/49 |
| 4,419,184 | 12/1983 | Backlund | 162/49 |

FOREIGN PATENT DOCUMENTS

| | | | |
|---|---|---|---|
| 1417503 | 10/1952 | Fed. Rep. of Germany | 162/238 |
| 445033 | 5/1973 | U.S.S.R. | 162/238 |

*Primary Examiner*—Steve Alvo

*Attorney, Agent, or Firm*—Burns, Doane, Swecker & Mathis

[57] ABSTRACT

A method for controlling an oxygen-bleaching process of lignocellulosic pulp to a desired degree of delignification.

The pulp is passed at a substantially constant temperature into a bleaching reactor wherein the pulp has a substantially constant level at its outlet. The hydrostatic pressure is measured and the quantity of oxygen fed into the reactor is adjusted to reach a desired degree of delignification.

4 Claims, 2 Drawing Sheets

METHOD FOR CONTROLLING AN OXYGEN BLEACHING

Figure 1:
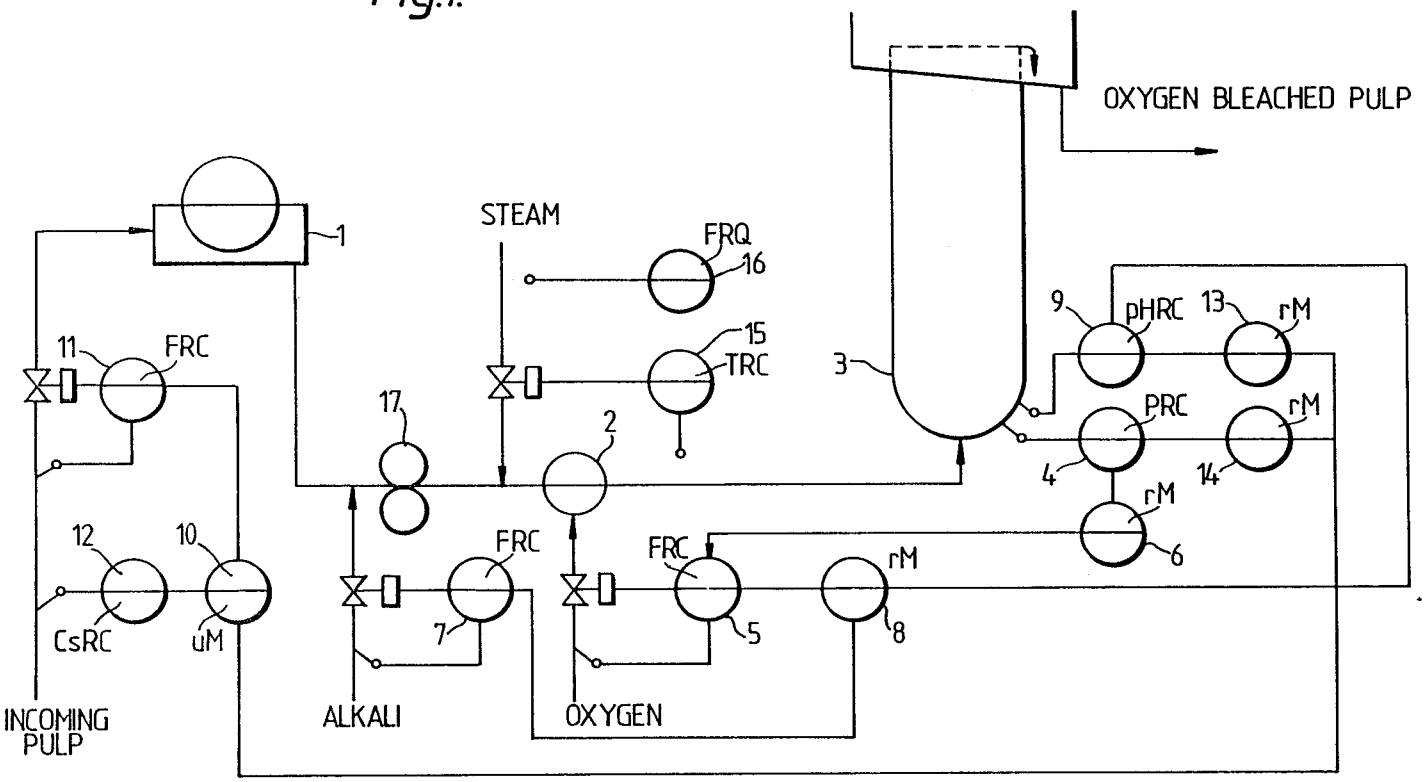

This application is a continuation of application Ser. No. 948,459, filed Dec. 31, 1986, now abandoned, which is a continuation of Ser. No. 744,985, filed June 17, 1985, now abandoned.

The present invention is concerned with a method by means of which the oxygen bleaching process of cellulose is controlled, wherein alkali and oxygen are added to the pulp stock flow and the flow is thereupon passed into the bleaching reactor.

In those oxygen bleaching processes with which the invention is concerned, initially the necessary addition of alkali and controlling of temperature are carried out, whereupon oxygen is mixed into the pulp so as to eliminate the lignin. After the mixing of oxygen, the pulp is passed into the reaction tower (=reactor), wherein the level of the outlet surface is constant. As a rule, a reactor is used in which the pulp flows from the bottom upwards, but the reversed arrangement may also be used. The reactor may operate under pressure or without pressure. In pressurized reactors, the delignification can be carried out at temperatures higher than 100° C. The function of the alkali in the process is to bind the reaction products produced, mainly the carbon dioxide, so that the ratio of the free alkali to the oxygen must be correct in the feed.

In the pressurized processes subject of the present invention, the pressure in the reactor at each particular point is the sum of the hydrostatic pressure of the reaction mixture and of the pressure in the upper end of the reactor. In a pressure-free process, the pressure is formed by the hydrostatic pressure only, and the pressure in the upper end of the reactor is zero.

If the process concerned is run with a very little dosage of alkali and oxygen, the delignification of the cellulose does not proceed to the desired level, and the results attainable by means of oxygen bleaching are not reached. In the contrary case, if the process is run with too high dosages of alkali and oxygen, the delignification does proceed far, but some of the alkali and oxygen remain unconsumed, and are lost.

Since the importance of a control of the cellulose delignification and of the reactor conditions is considerable both for the pulp quality and for the process economy, it should also be possible to adjust these factors within the limits permitted by the range of operation of the reactor.

With the present running technique, variations in the dosage of alkali and oxygen are taken care of on the basis of pulp analyses and liquor titrations. The making of chemical analyses, however, takes so much time, up to 4 . . . 8 h, that the controlling of the reaction cannot be brought to the scope of the control technique. So, the common practice is to run the processes constantly with standard dosages. Thus, the process conditions are changed constantly in accordance with variations in the pulp stock that is being supplied, which results in constant variations in the pulp quality and, at times, in unnecessarily high chemical costs.

Now a control method for the oxygen bleaching process has been invented in which the hydrostatic pressure in the reactor is measured and the quantity of feed of alkali or oxygen is adjusted in accordance with the variations in the measured pressure so as to reach the desired degree of delignification.

The influence of gaseous oxygen on the hydrostatic pressure in the reactor is significant. The proportion of oxygen gas at the normal-temperature pressure (NTP) is even higher than 100% of the volume of the cellulosic stock. Since the processes subject of the invention are run as constant-temperature controlled and since the change in the alkali dosage is, at the maximum, as an addition of solution, of the order of 0.5% of the overall liquor flow, the effect of these factors on the hyrostatic pressure remains little. If necessary, they can, however, be taken into account.

With the control method in accordance with the invention, the degree of delignification of the cellulose can be controlled to the desired level and kept constant by using an optimal dosage of chemicals. The process can be managed and controlled easily, and the result is always pulp of homogeneous quality.

In the following, a method in accordance with the invention will be described in more detail with reference to FIG. 1.

The incoming pulp is passed via the thickness control 12 and the flow-quantity control 11 to the washer/-thickener 1. Thereupon, alkali is added to the pulp, and the pulp is pumped 17 via the oxygen mixing 2 to the bottom end of the reaction tower 3 operating at the normal pressure. Before addition of the oxygen, the temperature of the pulp is raised to the desired level by means of steam. The oxygen-bleached pulp flows out through the upper end of the reactor 3. At the bottom end of the reactor 3, there is a pressure detector and a related control circuit 4, which adjusts the hdyrostatic pressure in the reactor to the desired value by changing the oxygen dosage 5 by means of a quotient relay 6. A change in the flow quantity of oxygen gives—via a quotient relay 8—the alkali-quantity controller 7 a new set value, whereby the alkali-oxygen ratio in the supplied pulp remains at the desired level. The reactor is also provided with a pH-detector with control circuit 9, by means of which the set value of the quotient relay 8 is chosen. The pH-instrumentation may also be constructed such that, with all running rates 10 (running rate=factual mass flow calculated from the measured flow quantity 11 and from the thickness 12), it automatically takes care of the correct alkali-oxygen ratio by means of the quotient relay 13 and the pH-controller 9. The changing of the set value of the hydrostatic pressure 4 is taken care of by the running rate 10 via the quotient relay 14. The basic level of the set value of the hydrostatic pressure 4 and the effects of the running rates 10 on the set values of the hydrostatic pressure 4 and the pH-controller 9 (=tunings of the quotient relays 13 and 14) are determined on the basis of the lignin reduction measurements of the process. Moreover, in the process of FIG. 1, the adjustment 15 of the temperature of the pulp stock as well as the measurement 16 of the quantity of the heating steam are illustrated. The equipment in accordance with the invention can be accomplished by making use of measurement and control elements in themselves known.

Arrangements of other sorts, besides those illustrated in FIG. 1, may also be applied. For example, the hydrostatic pressure in the reactor may be measured at different levels, and the differences in pressure obtained in this way be used for the control. Well suitable for the control of a pressurized bleaching process is, e.g., a method in which the difference in pressure between the upper end and lower end of the reactor is measured. In a pressurized process, of course, the positive pressure in the reactor must be kept precisely constant in order that its variations could not act upon the hydrostatic pressure, or then, its effect must be taken into account.

EXAMPLE 1

Figure 2:
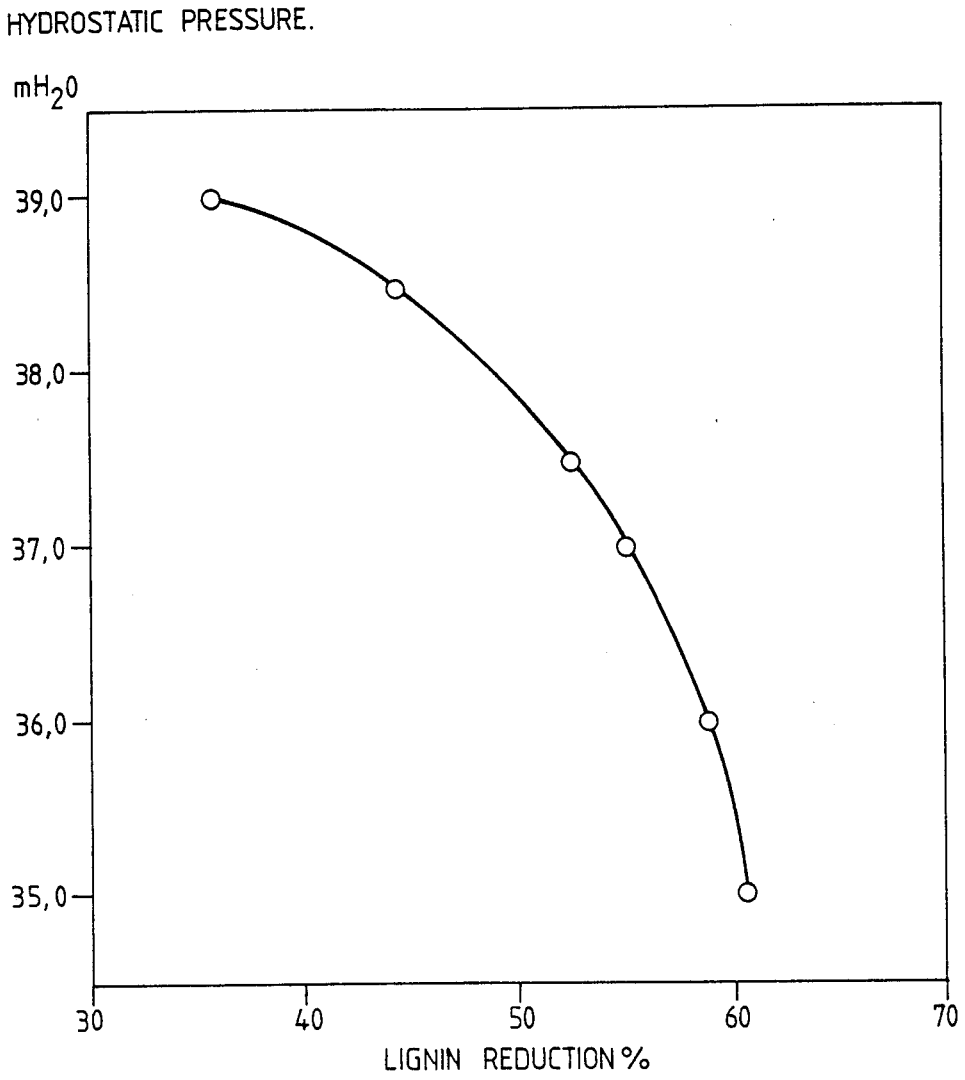

In order to establish the interdependence of the hydrostatic pressure in a bleaching reactor and the lignin reduction, a series of tests was carried out by means of a factory-scale equipment in accordance with FIG. 1. The cellulosic pulp that was used was sodium-sulfite silk pulp, which was made of spruce and pine so that the production of pine was about 80%. The lignin reduction was determined as the IBC-number. The results are shown in FIG. 2 and in Table 1. From the results, an evident interdependence of lignin reduction and hydrostatic pressure can be seen.

The significance of the control method now invented is in practice quite obvious, for it makes the oxygen bleaching better controllable, whereby the objectives of the process both in respect of the overall chemicals costs of the factory and in respect of the reduction in the burdening of the environment are achieved more readily. Moreover, disturbances caused by dosage errors in the process can be eliminated, and the control of the pulp quality is improved. By means of the method now invented, it is possible to accomplish computer control of the oxygen bleaching process in a simple and reliable way.

TABLE 1

| INCOMING PULP | | OXYGEN BLEACHING | | | | | |
|---|---|---|---|---|---|---|---|
| Quantity t/h | IBC | Alkali kg/mt | Oxygen kg/mt | Temperature °C. | Hydr. pressure m $H_2O$ | OUTGOING PULP IBC | LIGNIN REDUCTION % |
| 18 | 3.5 | 10 | 3 | 94 | 39.0 | 2.25 | 35.7 |
| 18 | 3.4 | 10 | 3 | 95 | 38.5 | 1.90 | 44.1 |
| 18 | 3.6 | 12 | 4.5 | 94 | 37.5 | 1.72 | 52.2 |
| 18 | 3.5 | 14 | 6 | 95 | 37.0 | 1.60 | 54.3 |
| 17 | 3.5 | 15 | 7 | 95 | 36.0 | 1.45 | 58.6 |
| 16 | 3.3 | 16 | 8 | 95 | 35.0 | 1.25 | 60.9 |

What is claimed is:

1. Method for controlling an oxygen-bleaching process of lignocellulose pulp stock to a desired degree of delignification comprising adding alkali oxygen at a desired ratio to the pulp stock, passing the pulp at a desired substantially constant temperature into and out of the bleaching reactor wherein the pulp has a substantially constant level at its outlet measuring the hydrostatic pressure at the bottom of the reactor and adjusting the quantity of feed of oxygen in response to the measured hydrostatic pressure, to a value to reach the desired degree of delignification; and adjusting the amount of alkali added in response to the adjusted amount of oxygen to maintain the alkali and oxygen ratio at the desired ratio.

2. Method as claimed in claim 1, wherein the pulp flow is passed into the flow reactor through its bottom end and out of the reactor through its upper end.

3. Method as claimed in claim 1 further comprising measuring the pH of the pulp flow passed into the reactor and adjusting the quantity of alkali in accordance with the changes in the measured pH.

4. Method as claimed in claim 2 further comprising measuring the pH of the pulp flow passed into the reactor and adjusting the quantity of alkali in accordance with the changes in the measured pH.

* * * * *